United States Patent [19]

Rusk

[11] 4,033,283

[45] July 5, 1977

[54] APPARATUS FOR INTERACTING WITH ARTICLES PASSING THERETHROUGH

[75] Inventor: Thomas P. Rusk, Macon, Ga.

[73] Assignee: Brown & Williamson Tobacco Corporation, Louisville, Ky.

[22] Filed: July 7, 1975

[21] Appl. No.: 593,255

[52] U.S. Cl. ..... 118/1; 118/241

[51] Int. Cl.[2] ..... B05C 1/02

[58] Field of Search ..... 118/1, 2, 241, 258, 118/8; 53/75, 76

[56] References Cited

UNITED STATES PATENTS

| | | | |
|---|---|---|---|
| 2,557,696 | 6/1951 | Schaefer | 118/1 |
| 2,585,330 | 2/1952 | Kayser | 118/1 |
| 2,620,767 | 12/1952 | Lehman | 118/2 |
| 2,625,085 | 1/1953 | Bergstein | 118/2 X |
| 3,340,847 | 9/1967 | Miller et al. | 118/2 |
| 3,426,502 | 2/1969 | Greenberg | 118/8 X |
| 3,496,697 | 2/1970 | Loveland et al. | 118/2 X |
| 3,777,702 | 12/1973 | Fitzgerald | 118/2 |

*Primary Examiner*—John P. McIntosh
*Attorney, Agent, or Firm*—William J. Mason

[57] ABSTRACT

An apparatus for interacting with articles passing through the apparatus. A spacially separate pair of switches are placed along the direction of movement of the articles and are disposed to detect the leading and trailing edges of the article. Output from the switches is received by a control system that produces an activating signal only when the pair of switches are in dissimilar states. The activating signal is received by means that interact with the article upon receipt of the activating signal.

4 Claims, 8 Drawing Figures

APPARATUS FOR INTERACTING WITH ARTICLES PASSING THERETHROUGH

FIELD OF THE INVENTION

The present invention relates to that portion of the art where automated equipment interacts with articles passing therethrough in response to the position of the article within the apparatus. More particularly, the present invention relates to automated means for applying adhesive cartons passing through the apparatus in response to the position of the carton.

BACKGROUND OF THE INVENTION

Most articles that are commercially shipped are placed within corregated cardboard containers, hereinafter referred to as cartons. The carton filled with the articles to be contained are sealed by application of adhesive to appropriate carton components. The application of the adhesive to the carton components must be controlled since the adhesive should not be applied to any of the articles within the carton. If adhesive is applied to the carton contents, the subsequent opening of the carton will damage the articles therein.

Furthermore, if the articles within the carton are affixed to one another as well as to the carton, the articles may be removed from the carton while affixed without noticing the condition. If the articles are then placed in a location to be dispensed and sold then the affixed condition of the articles can cause problems with the sale of the articles.

Further compounding the problem is the fact that after the carton has been sealed, there is no practical means for detecting whether or not the articles within the carton have mistakenly received adhesive. The problem is discovered only after the carton has left the control of those who could alleviate the problem by repacking the articles in another carton and applying the adhesive properly. The purchasers who discover the defect have no means to correct the defect other than return the carton and its contents. The return of such materials is a waste of effort by the purchaser and those responsible for repacking the cartons.

This has created a longstanding search for a means to apply adhesive only to predetermined portions of cartons.

U.S. Pat. No. 3,769,777 Miller et al., discloses a case sealer that applies adhesive only to the end flaps of a carton. The application of the adhesive is controlled by four switches, two of which contact the carton and two of which contact a portion of the carton manipulating apparatus termed the flight bar. The switches taught are conventional electrical micro-switches requiring physical contact with the apparatus or the carton to make or break the electrical circuit.

Similarly, U.S. Pat. No. 3,496,697 Loveland et al., teaches an apparatus for applying adhesive to a carton prior to a closing operation. The application of adhesive is controlled by a linear array of four conventional electrical switches disposed along the direction of movement of the carton through the apparatus. The necessity of four switches in this reference as well as the previously cited reference increases the probability of malfunction since the switches are repetitively used. Furthermore, the failure of one particular switch in the array can result in the application of adhesive to the contents of the carton as well as both the end flaps.

By contrast, any probable combination of failure of either of the two switches of the present invention causes easily detectable incomplete misapplications of the adhesive, which cannot result in complete sealing of the carton with adhesive applied to its contents. Therefore, if the carton is completely sealed, those packing the carton and the purchasers of the articles within it can be assured that the contents of the cartons are not affixed to the carton itself. Furthermore, if a switch failure causes adhesive to be applied to the carton's contents, the carton will be incompletely sealed and easily detected. The improperly sealed cartons resulting from malfunction of the present invention visually appeared sealed, however, since one end is unsealed, it is structurally weaker than a correctly sealed carton and human handling of the carton will normally result in its detection. Furthermore, if after the apparatus has been utilized, it is discovered the cartons are improperly sealed, previously sealed cartons can externally be inspected to detect the improper application of adhesive. The external inspection consists simply of determining if either extremities of the external side flaps are not affixed to the end flaps. By contrast, the prior art devices create improperly sealed cartons that are externally indistinguishable from properly sealed cartons.

Therefore, it is a primary object of the invention to provide a more reliable apparatus for interacting with articles passing therethrough.

Another object of the invention, when the invention is embodied is an apparatus for applying adhesive to cartons, is to provide an apparatus that cannot completely seal a carton and apply adhesive to its contents upon the failure of the switch elements.

Still another object of the invention is to seal cartons in such a manner that malfunction of the apparatus will result in mis-sealed cartons that are externally detectable by unskilled personnel.

An additional object of the invention is to provide an apparatus that is easily adapted to various size articles passed therethrough.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purpose of the invention, as embodied and broadly described herein, the apparatus of this invention comprises means for sequentially detecting the leading and trailing extremities of members passing through the apparatus. The detecting means comprise a pair of spacially separate switches that are separated a predetermined distance along the direction of movement of the members through the apparatus. Control means receive output from the detecting means and generate an activating signal only when the switches of the detecting means are in dissimilar states. Means for interacting with members passing through the apparatus do so in response to the activating signal.

Preferably, the apparatus is disposed to apply adhesive to predetermined portions of cartons passing through the apparatus. In such an embodiment, the means for sequentially detecting the leading and trailing edges of the carton would be a pair of spacially separate photocells. The photocells are spacially separated a predetermined distance along the direction of movement of the cartons. The photocells are disposed to detect the interruption of two parallel light beams that are perpendicular to the direction of movement of the cartons and separated one from the other the perdetermined distance. Preferably, the predetermined distance is approximately twice the desired length of the adhesive application. Control means receiving output from the detecting means generate an activating signal only when either of the light beams are interrupted by the passage of the carton through the apparatus. The means for applying adhesive to the predetermined portions of the cartons act in response to the activating signal. The adhesive applying means is placed in a position to contact the predetermined portions of the cartons and is preferably at a location equidistant from the light beams.

It is further preferred that the adhesive applying means be a plurality of adhesive bearing rollers moved into contact with the predetermined portions of the cartons.

BRIEF DESCRIPTION OF THE DRAWINGS

The invention consists in the novel parts, constructions, and arrangements, combinations and improvements shown and described. The accompanying drawings, which are incorporated in and constitute a part of this specification illustrate one embodiment of the ivention and, together with the description, serve to explain the principles of the invention.

Of the Drawings.

DESCRIPTION OF THE PREFERRED EMBODIMENTS

Reference will now be made in detail to the present preferred embodiment of the invention, an example of which is illustrated in the accompanying drawings.

The invention comprises three basic elements; a detecting means a control means and an interacting means.

The detecting means sequentially detects the leading and trailing extremities of members passing through the apparatus. In accordance with the invention, the detecting means comprises a pair of spacially separate switches separated a predetermined distance along the direction of movement of articles passing through the apparatus.

Figure 2:
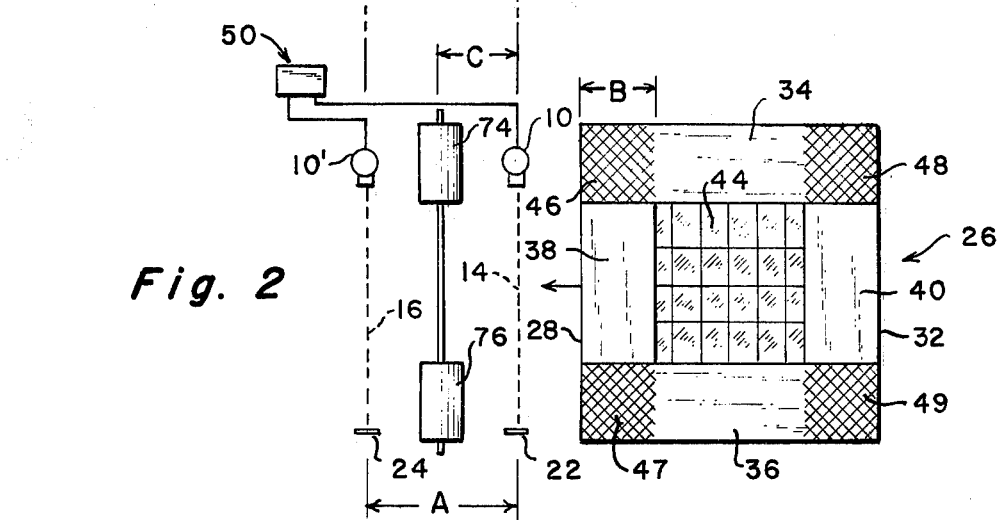
FIG. 2 is a top view of one embodiment of the invention where photocells control the movement of adhesive bearing rollers onto the sideflaps of a carton passing through the apparatus.
Figure 3:
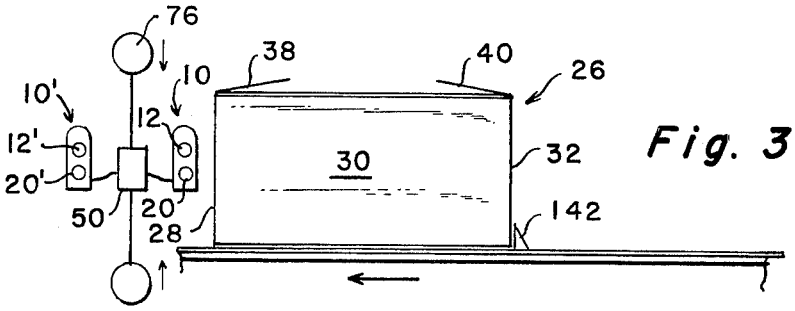
FIG. 3 is a side view of the embodiment of FIG. 2.
Figure 4:
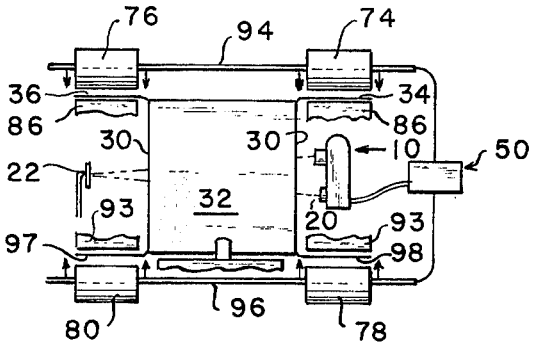
FIG. 4 is an end view of the embodiment of FIGS. 2 and 3.

As here embodied, and most clearly depicted in FIGS. 2, 3 and 4, the detecting means comprises a pair of spacially separate photocell switches 10 and 10'. The photocell switches are separated a predetermined distance indicated as A in FIG. 2. Preferably, the photocells each include an integral light source 12 and 12' that generate parallel light beams 14 and 16 that are reflected back to the photocell detectors 20 and 20' by the reflectors 22 and 24. While the photocell switches 10 and 10' are depicted with the light sources 12 and 12' separated from the photocell detectors 20 and 20', the separation is for clarity of description only and commercial devices may be used having coincident light sources and detectors. In the embodiment depicted, the interruption of the light beams 14 and 16 by the member (depicted herein as carton 26) and the detection of the interruption by the photocell switches 10 and 10' provide a reliable non-contacting pair of spacially separate switches. The photocell switches need not be of the specific configuration depicted and the light source may be opposite and directed toward the photocell thereby eliminating the need for the reflectors. Furthermore, the switches need not be photocell switches since any switching means can be used to detect the extremities of the member passing through the apparatus. The photocell switches are preferred since they do not physically contact the member passing through the apparatus. The non-contacting feature is advantageous for several reasons. Since it is desired that the apparatus be adaptable to different size members (as for example cartons 26), it is preferred the switches be adjustably affixed to the apparatus. If the switches contact the members passing through the apparatus, it would require strong and reliable means for affixing the switches to the apparatus to resist being moved out of adjustment by contact with members passing through the apparatus. The photocell switches may be conveniently mounted on adjustment means that is relatively simple without the necessity for complex locking means to maintain their spacial relationship. The relatively simple mounting of the photocell switches also facilitates convenient adjustment of the photocells. Furthermore, photocell switches may be externally sealed and therefore lack moving parts that are exposed to materials that could jam or damage parts of the switch. This makes the photocell switches inherently more reliable than conventional contacting electrical switches that conveniently have exposed moving parts.

While the preferred embodiment of the switches has been disclosed to be a pair of photocell switches other non-contacting switches may also be used with the invention and one skilled in the art could substitute such devices for the photocells specifically disclosed without specific teaching of the means of substitution.

In the embodiment depicted where a carton 26 is the member passing through the apparatus and photocells are used as switches, as depicted in FIGS. 2 and 3, the carton first encounters the light beam 14 with the leading edge 28 of the carton. Upon further movement, the sides 30 of the carton continue to interrupt the light beam 14 until the carton trailing edge passes the cartons trailing edge 32. Prior to the trailing edge 32 passing the light beam 14, the leading edge 28 encounters and interrupts the light beam 16 and subsequently passes through the apparatus until the light beam 16 encounters the trailing edge 32 of the carton 26 and is once again uninterrupted.

Therefore, it can be seen that the switches operate under four sequential conditions. The first condition is when both switches (depicted here as photocells) are in similar states since there is no member within the apparatus to interface with the switches and, therefore, they are in the same condition. The first condition can be with the member (as for example the carton 26) entering the apparatus and not yet interfacing with the first (leading) switch as depicted in FIGS. 2 and 3, or after the member has passed through the apparatus subsequent to the interface with the second (trailing) switch. The condition of the switches prior to the interface with the member can be either conductive or both non-conductive depending upon the control system utilized. For purposes of this disclosure, the switches are conductive only when interfacing with a member within the aparatus. The term "interfacing" encompasses contacting for conventional electrial switches that physically contact the member or detection by non-contacting switches. Therefore, when a member (such as carton 26) has not yet interfaced with the switches, they are both non-conductive and in similar states. This is the first possible condition for the switches. The condition is depicted in the embodiment of FIGS. 2 and 3 where the leading edge 28 of the carton 26 has not yet encountered the light beam 14.

The second condition is where the member has interfaced with only the first switch in the pair. In the embodiment depicted the leading edge 28 of the carton 26 would have passed the light beam 14 but not yet interrupted light beam 16. This condition is schematically depicted in FIGS. 1A and B that will be discussed in detail in the portion of the specification dealing with the operation of the preferred embodiment. In the second condition, the switches are in dissimilar states since the first switch is conductive and the other which has not yet interfaced with the member passing through the apparatus is not conductive. The third condition of the switches is depicted schematically in FIG. 1C where the member is interfacing with both switches. For the embodiment disclosed both are conductive and, therefore, again in similar states. The fourth condition for the switches is schematically depicted in FIGS. 1D and 3 where the member is no longer interfacing with the leading switch which would in this embodiment be non-conductive. The member is still interfacing with the trailing switch and it would be conductive. In this fourth condition, the switches would again be in dissimilar states. As previously disclosed, after the member has passed through the apparatus and is no longer interfacing with the trailing switch, the switches are again in similar states.

The purpose of the detecting means previously disclosed is to generate an output that is dependent on the position of the member passing through the apparatus. As will be more fully disclosed in the description of the preferred control means, the embodiment described interacts with the member in response to the conditions detected by the switches. Therefore, the distance between the switches effects the output from the detecting means. This distance is depicted in FIG. 2 as the distance A between the photocell switches 10 and 10′ and the associated light beams 14 and 16. If the distance between the switches is significantly reduced, the switches will still go through the previously disclosed four conditions but the length of the dissimilar states is reduced. This distance is, therefore, preselected for the configuration of the members passing through the apparatus to yield the dissimilar state at the switches when the member is at the appropriate position within the apparatus.

In the preferred embodiment depicted, the apparatus is for applying adhesive to predetermined portions of cartons passing through the apparatus.

As here embodied and schematically depicted in FIGS. 2, 3 and 4, the apparatus is disposed to receive a carton 26. The carton 26 is comprised of: leading edge 28, trailing edge 32, side flaps 34 and 36, leading end flap 38, trailing end flap 40 and sides 30. The carton contains a plurality of articles 44. In the embodiment, it is desired to place adhesive on the sideflaps 34 and 36 at a predetermined location so that when the sideflaps are folded to close the carton the adhesive on the predetermined portions will contact only the end flaps 38 and 40 and not the articles 44. As depicted in FIG. 2, the predetermined areas on the sideflaps 34 and 36 are shown as crosshatched areas 46, 47, 48 and 49. The length of the four predetermined areas is depicted as distance B in FIG. 2. The switches, photocells 10 and 10′ are separated a predetermined amount (A) and preferably the length of the predetermined distance A is approximately twice the desired length (B) of the adhesive application.

In accordance with the invention, a control means receives output from the detecting means. As here embodied, the control means comprises an electrical subsystem within the photocells to provide an output in response to the position of the member passing through the apparatus as detected by the photocell detectors 20 and 20′. The basic characteristic of the control means is that it generates an activating signal only when the switches in the detecting means are in dissimilar states. In the embodiment depicted herein, the control means generates an activating signal only when either one of the light beams 14 or 16 is interrupted by the passage of the carton 26.

Figure 5:
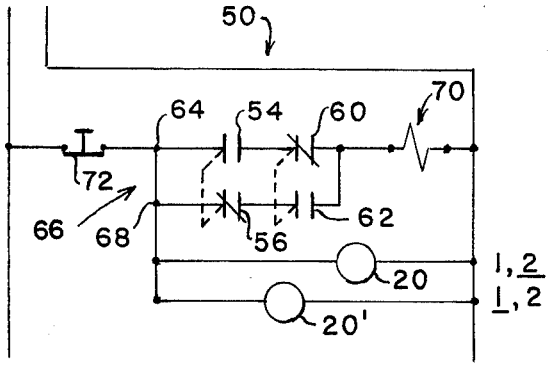
FIG. 5 is a schematic representation of an electrical circuit that provides an activating signal when the switches are in dissimilar states.

FIG. 5 depicts an electrical schematic of an operable control means 50 utilizing two photocell detectors 20 and 20′ as the leading and trailing photocells respectively. Associated with the leading photocell is a relay (not shown) that controls ganged pairs of photocell contacts 54 and 56. When the relay is unactivated, contacts 54 are normally open and contacts 56 are normally closed. As a result of the ganged relationship of the contacts 54 and 56, when the photocell relay is activated by the interruption of the light beam 14 contacts 54 are closed and contact 56 are open.

Similarly, ganged pairs of contacts 60 and 62 are operated by another relay (not shown) associated with the trailing photocell 10′. When the relay is unactivated, contacts 60 are normally closed and contacts 62 are normally open. As depicted in FIG. 5, contacts 54 and 60 are connected in series in one branch 64 of a parallel circuit 66 and contacts 56 and 62 are in series in the other branch 68 of the parallel circuit. The parallel circuit 66 provides an activating signal to a solenoid 70 that is associated with the interacting means to be hereinafter disclosed. An off-on control switch 72 is also provided in series with the parallel circuit 66 that can prevent the activating signal irrespective of the condition of the photocells 10 and 10′ and their associated relay contacts.

The function of the control means embodied herein is most clearly disclosed by correlating the condition of the contacts with the four conditions of the detecting means previously disclosed. The first condition where neither photocell is interrupted is depicted in FIG. 5 with contacts 54 open circuiting one branch 64 and the contacts 62 open circuiting the second branch 68 of the parallel circuit 66 thereby preventing voltage (the activating signal) to the solenoid 70. In the second condition with the leading photocell 20 interrupted, the ganged contacts 54 and 56 are changed so that normally open contacts 54 are closed and normally closed contacts 56 are open. Therefore, in the second condition with photocell 10 interrupted, there is current path through now closed contacts 54 and normally closed contacts 60. In the third condition where both photocells are interrupted, contacts 54 remain closed and contacts 56 remain open as in the second condition. However, photocell 10′ is interrupted and normally closed contacts 60 are now open and normally open contacts 62 are closed. Therefore, in the third condition, branch 64 is open circuited by contacts 60 and branch 68 is open circuited by contacts 56. This prevents the current from reaching solenoid 70. In the fourth condition, only photocell 10′ is interrupted. Therefore, as depicted in FIG. 5 contacts 54 are open and contacts 56 are closed. Due to the interruption of photocell 10′ normally closed contacts 60 are open and normally open contacts 62 are closed. In the fourth condition, branch 68 is conductive through contacts 56 and 62 to activate the solenoid 70.

In accordance with the invention there are provided means for interacting with the members passing through the apparatus in response to the activating signal.

As here embodied, interacting means comprise means for applying adhesive to predetermined portions of cartons passing through the apparatus. Preferably, the means for applying the adhesive comprise a plurality of adhesive bearing rollers moved into contact with portions of the carton in response to the activating signal. As here embodied and depicted in FIGS. 2, 3, 4 and 6, upper rollers 74 and 76 are disposed to contact the upper side flaps 34 and 36 while the lower rollers 78 and 80 are disposed to contact the lower side flaps 97 and 98. The rollers all bear adhesive and therefore apply adhesive to the upper and lower side flaps when they are in contact.

Figure 8:
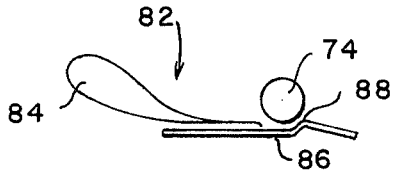
FIG. 8 is a detail view of the embodiment of FIGS. 6 and 7 illustrating the relationship of the rollers and the flap supporting means.

A preferred means of manipulating the side flaps of cartons in the proximity of the rollers is depicted in FIG. 8. While the embodiment shown in FIG. 8 depicts an upper side flap manipulating means 82 a similar structure could be reversed to serve as lower side flap manipulating means. The folding element 84 takes a substantially vertical side flap and folds it to the horizontal position depicted in FIG. 4. In this embodiment, lower support 86 is positioned below the side flap and below the associated roller 74 or 76. Preferably, the support (whether lower or upper) would extend beyond the centerline of the associated roller 74 and include a raised portion 88 at a location past the centerline of the associated roller 74. It would also be preferred that the support include a vertical adjustment to allow the space between the roller 74 and the support 86 to be changed.

Figure 6:
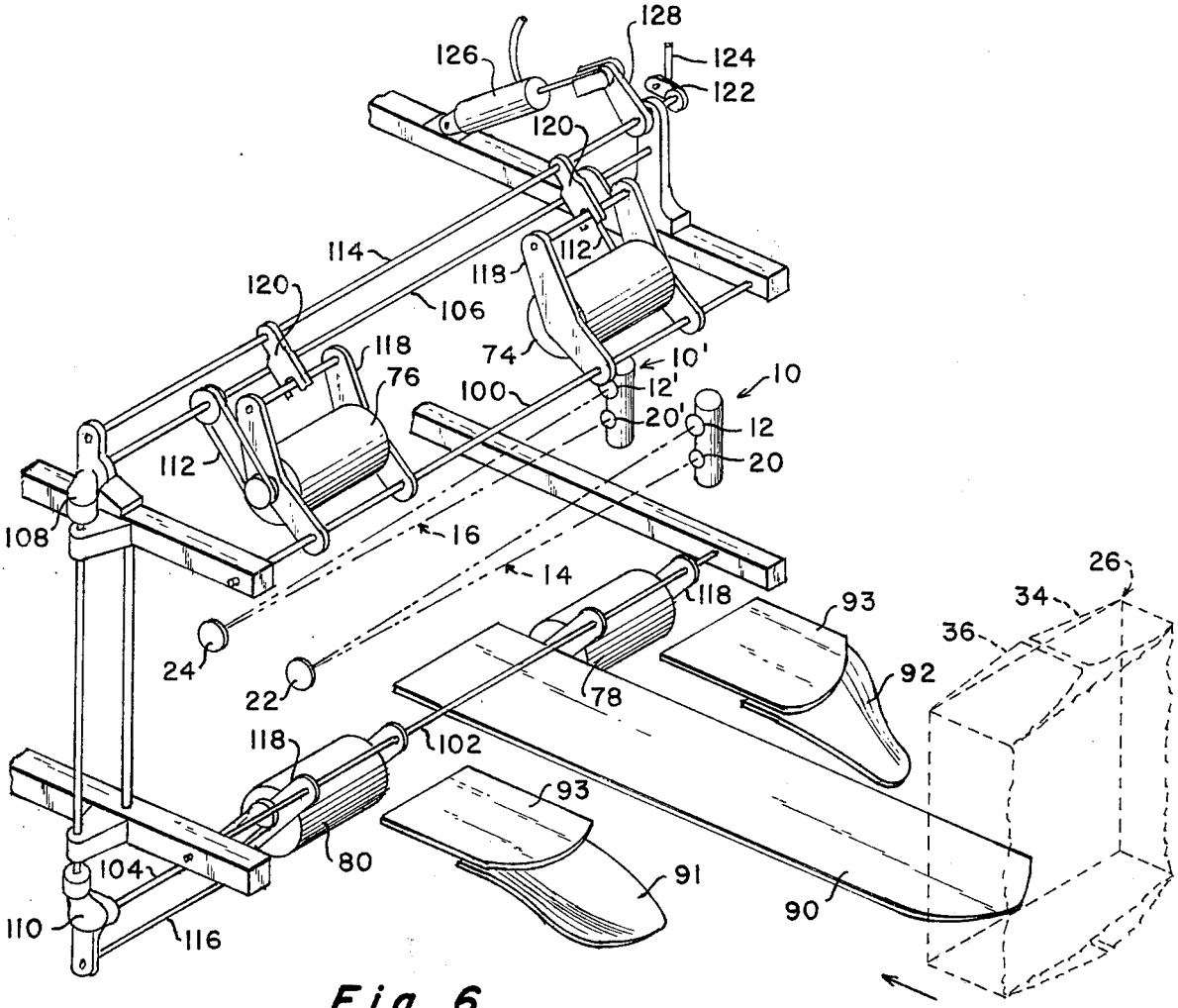
FIG. 6 is a perspective view of a carton sealing apparatus employing the present invention.

Another similar embodiment of flap manipulating means is depicted in FIG. 6 where a flap opening member 90 is disposed to open the lower side flaps to contact the deflecting member 91 and 92. Lower flap support members 93 (also shown schematically in FIG. 4) support the lower side flaps proximate the lower adhesive applying rollers 80 and 78.

As depicted in FIG. 4, upper rollers 74 and 76 are mounted on a common upper roller shaft 94 and therefore move to contact the upper flaps 34 and 36 in unison. It is also preferred that the lower rollers be mounted on a common shaft (depicted in FIG. 4 as lower roller shaft 96) so that the lower rollers move to contact the lower side flaps 97 and 98 in unison. It is further preferred that the pairs of upper and lower rollers be mechanically linked to move toward the carton simultaneously with each of the rollers disposed to contact one side flap.

While there are many operable means of arranging and driving the rollers, a preferred embodiment is depicted in FIG. 6. Upper rollers 74 and 76 are pivotally mounted on a common shaft 100 with the lower rollers 78 and 80 similarly mounted on a common shaft 102. All the rollers are driven from co-driven shafts 104 and 106 linked by shaft 106 through bevel gears 108 and 110. The driven shafts 104 and 106 are engaged to drive the rollers through chains 112. The rollers, all being driven from co-driven shafts, all rotate at the same speed and as will be hereinafter disclosed are driven at a speed synchronous with the speed of the articles moving through the apparatus and other associated elements operating on the articles.

An upper activating shaft 114, having an analogous lower activating shaft 116, engage the frames 118 supporting the rollers through engaging members 120. The upper activating shaft 114 is linked to the lower activating shaft 116 by means of an upper bellcrank 122 and a connecting shaft 124. For purposes of clarity in FIG. 6, the lower portion of the connecting shaft 124 has been omitted, however, it is mounted to the lower activating shaft in such a manner that rotation of the upper activating shaft 114 in a manner to lower rollers 74 and 76 will rotate lower activating shaft 116 in a manner to lower rollers 78 and 80. Upper activating shaft 114 is rotated in response to the control means 50 by means of a slave cylinder 126. In the embodiment depicted, the solenoid 70 would control the application of pressure to the slave cylinder 126 in response to the activating signal. Linear expansion of the slave cylinder 126 rotates upper activating shaft 114 through bellcrank 128 which would in turn move all the rollers toward the carton 26 when it is appropriately positioned within the apparatus.

Figure 7:
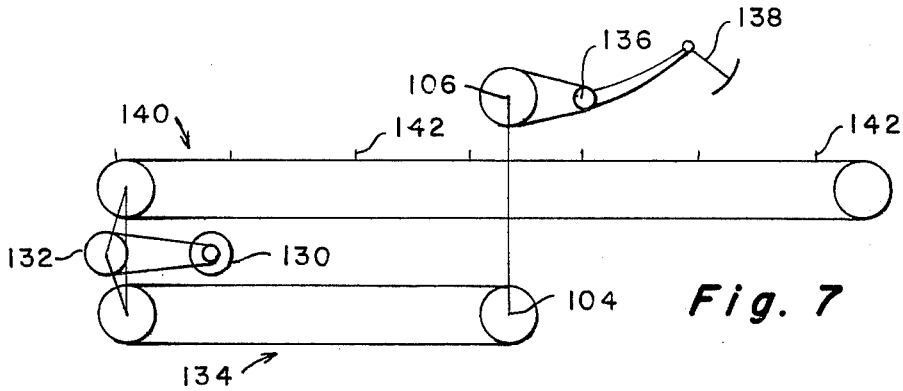
FIG. 7 is a schematic representation of the drive system of the embodiment of FIG. 6.

A preferred means of driving the articles through the apparatus is depicted in FIG. 7. In that embodiment, a motor 130 drives two basic drive systems through gear reduction means 132. Since the systems are co-driven, they operate synchronously. Roller drive system 134 drives the rollers and in the embodiment depicted in FIG. 6, drives shafts 104 and 106 that, in turn, drive the rollers through chains 112. Also depicted in FIG. 7 is a means to tuck the trailing end flap 40 of a carton 26 down so the flap will be folded forward when the carton enters the apparatus. Shaft 106 provides the drive to an intermediate shaft 136 that, in turn, rotationally drives the trailing end flap tucking member 138.

The article drive means 140 is also co-driven by the gear reduction means 132. It is the function of the article drive means to propel articles through the apparatus. When the articles are cartons 26, the article drive means includes article engaging means depicted as projections 142. The projections 142 engage the trailing edge 32 of the carton 26 and propel the carton through the device. The drive means disclosed provides synchronous movement of the articles passing through the apparatus with the various subsystems that perform the sequential operations on the article.

While the invention may be used to interact with members of various configurations, when the member is a carton to be sealed by the application of adhesive, it is preferred the carton and the apparatus be disposed as it is most clearly depicted in FIG. 4. FIG. 4 depicts the carton 26 in an end view with the side flaps 34, 36, 97 and 98 horizontally disposed with the inner surface of the side flaps (that will ultimately contact the end flaps and the contents of the carton) in a position to be contacted by the adhesive bearing rollers.

As depicted in FIG. 2, it is preferred that the rollers have their axis of rotation equidistant from the light beams 14 and 16. In such an embodiment, the distance C from either of the two switches (depicted in FIG. 2 as photocells 10 and 10') to the point at which the interacting means interacts with the member. As embodied herein, the distance B on the carton 26 corresponds to the length of the desired adhesive application and is equal to ½A which is in turn equal to distance C. The ramifications of this preferred spacing of the elements will be apparent when the operation of the invention is disclosed.

OPERATION OF THE PREFERRED EMBODIMENT

As depicted in FIGS. 2, 3 and 4, the carton 26 is propelled through the apparatus on a moving drive means as schematically depicted in FIG. 7. The carton contains articles 44 and both the upper and lower end flaps (e.g., upper end flaps 38 and 40) are folded to contact the articles within the carton. The carton 26 and the articles 44 therein are supported by the drive means with the side flaps horizonally disposed between upper and lower supports 86 and 93 respectively and the upper and lower rollers. When the carton 26 encounters the light beams 14 and 16 the rollers are activated to a position where they can contact the carton on the predetermined portions of the cartons. First, the leading portions 46 and 47 are contacted by the upper rollers 74 and 76 respectively while equivalent predetermined portions on the lower side flaps are simultaneously contacted by the lower rollers 78 and 80. Through operation of the detecting means and the control means, the rollers are retracted when the carton reaches a predetermined position within the apparatus and in a like manner, the rollers are again activated to contact the trailing portions 48 and 49 (as well as the lower side flap counterparts of those portions) when the carton is appropriately positioned within the apparatus. Subsequently, the side flaps are folded into contact with the cartons contents and the end flaps with the adhesive placed on the side flaps only where they contact the end flaps.

In a different embodiment, the rollers could apply the adhesive directly to the end flaps by merely moving the rollers toward the center of the carton on the shafts 94 and 96. Such an embodiment is operable but not preferred since the adhesive bearing rollers would be in close proximity to the articles 44 in the carton and the drive means would have to accommodate passage of the rollers therethrough.

Figure 1:
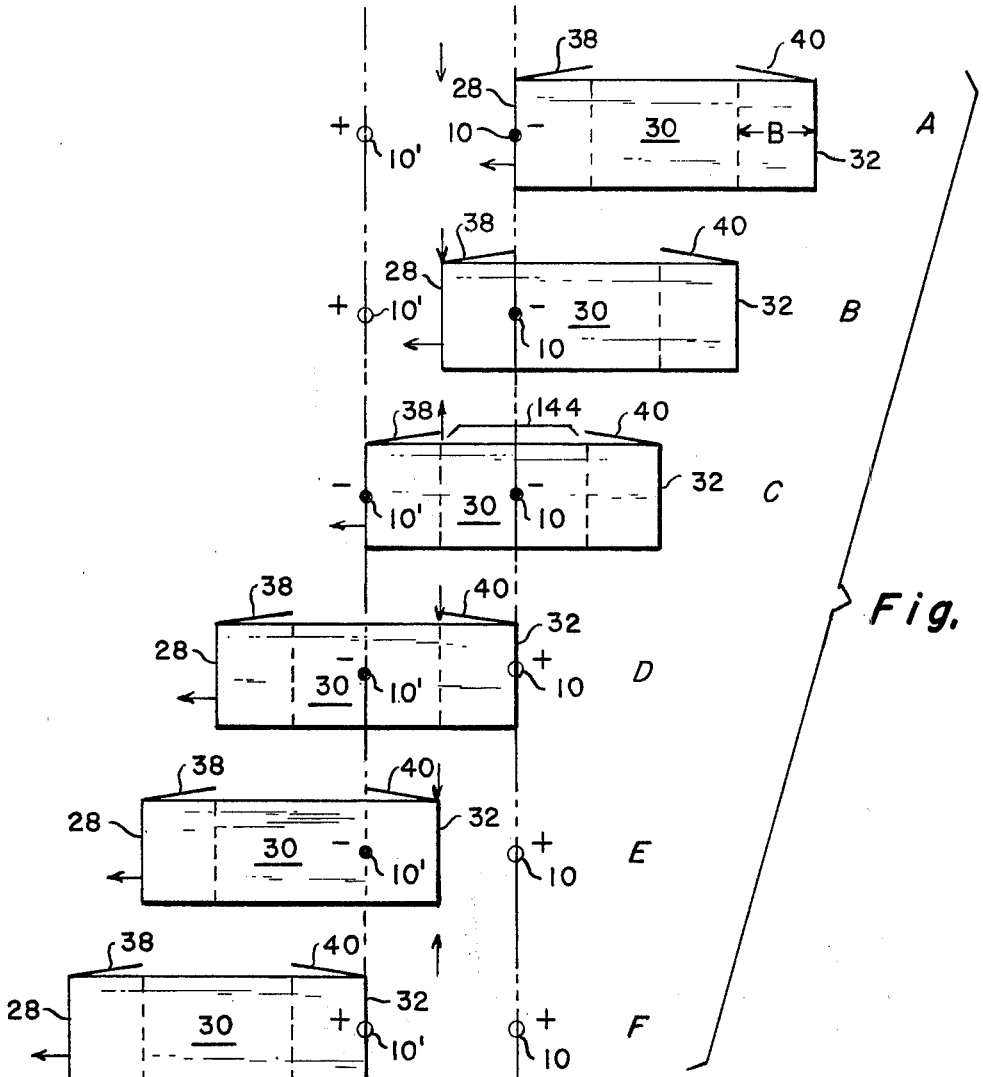
FIG. 1 illustrates a sequence of activation of the interacting means as a member passes through the switch array.

FIG. 1 depicts a schematic sequence of operation of the preferred embodiment of the invention that illustrates the major advantage of the invention. As previously disclosed the activating signal is only generated when the switches are in dissimilar states. In the figures, the switches have arbitrarily been labeled + when they are not detecting the member passing through the apparatus and − when they are. FIG. 1 uses the carton 26 as the member passing through the apparatus with the carton having a leading and trailing edge 28 and 32 respectively. The distance B represents the length of the desired adhesive application. The vertical arrow represents the state of the interacting means as for example the movement of the adhesive bearing rollers. When the arrow is pointing up, it would indicate the rollers are retracted conversely when the arrows point down the rollers are in a position to make contact with the carton.

FIG. 1A illustrates the condition of the apparatus when the leading edge 28 of the carton 26 encounters the leading switch 10, and since the switches are in dissimilar states, the activating signal is generated and the interacting means is activated. The carton 26 is not necessarily contacted in this configuration as illustrated in FIG. 1A, however, contact with the interacting means occurs as the carton is further transported through the apparatus as depicted in FIG. 1B. When the carton passes from the configuration shown in FIG. 1B to that shown in FIG. 1C, the interacting means has contacted the carbon for the predetermined distance and the leading edge 28 then encounters the trailing switch 10' as depicted in FIG. 1C, both switches are now in similar states and therefore at this point the interacting means is retracted from the carton. The interacting means remains retracted until the trailing edge 32 of the carton 26 encounters the leading switch 10 as depicted in FIG. 1D. At this point the switches are in dissimilar states and the activating means is brought into contact with the carton as indicated by the arrow. As indicated by FIG. 1E, the continued passage of the carton 26 through the apparatus results in the continued contact of the interacting means with the carton until the carton passes the interacting means as indicated in FIG. 1F, the interacting means is retracted when the trailing edge 32 of the carton 26 encounters the trailing switch 10'.

The major advantage of the present invention is the face that the failure of one of the switches in any condition either as indicated + or −, cannot result in the interacting means being in contact with the entire length of the carton and in the embodiments where it is applying adhesive to the carton filled with articles, the device cannot apply adhesive to both end flaps and the cartons contents.

For purposes of illustration, it will be assumed that the trailing switch 10' has failed in the + condition and that it cannot detect the presence of the cartons as it passes through the apparatus. The conditions depicted in FIGS. 1A and 1B will be identical since the carton has not yet come to the malfunctioning trailing switch 10', that is in the + condition, whether or not it is malfunctioning. However, when the leading edge 28 of the carton 26 encounters the trailing switch 10' as depicted in FIG. 1C, the trailing switch 10' will remain in a + condition. Since the switches are in dissimilar states, the activating means will remain in contact with the carton. In embodiments where adhesive is applied to a carton, it will apply adhesive to other than the predetermined areas as depicted by area 144 in FIG. 1C. However, when the carton reaches the position as indicated by FIG. 1D, the leading switch 10 becomes positive and because the trailing switch 10' is malfunctioning in the positive condition, these switches are in similar states and the interacting means retracts thereby incompletely sealing the carton. This condition is externally detectable and remedial measures taken prior to the carton leaving the location of those responsible for the adhesive application. Similar analyses can be carried out for all possible malfunctions of the switches and for all reasonable possibilities none can result in the activation of the interacting means over the complete length of the member passing through the apparatus. While there is a possibility of the switches simultaneously failing in dissimilar states, such a failure would be unreasonably improbable.

The invention provides an apparatus that reliably detects the position of members passing therethrough and provides means for interacting with preselected portions of those members without the possibility of interacting with the entire member upon the failure of the switch components of the apparatus.

It will be apparent to those skilled in the art that various modifications can be made in the apparatus and invention without departing from the scope of the invention as defined herein by the appended claims.

What is claimed is:

1. An apparatus for interacting with a predetermined portion of members passing therethrough comprising:

a. first and second detecting means separated a predetermined distance along a given pathway to detect the leading and trailing edges of members moving along said pathway, each of said detecting means having detecting and non-detecting states;

b. control means having first and second circuits, said control means generating an activating signal upon completion of either of said circuits;

c. a first pair of ganged contacts comprised of a first contact in said first circuit and a second contact in said second circuit, said first pair of ganged contacts being operably connected to said first detecting means to open one of said contacts and close the other of said contacts in response to a change in the state of said first detecting means;

d. a second pair of ganged contacts comprised of a first contact in said first circuit and a second contact in said second circuit, said second pair of ganged contacts being operably connected to said second detecting means to open one of said contacts and close the other of said contacts in response to a change in the state of said second detecting means;

e. said first and second pairs of ganged contacts being arranged to complete a circuit only when said detecting means are in dissimilar states; and f. means for interacting with a predetermined portion of said members in response to said activating signal.

2. The apparatus of claim 1, wherein said first and second detecting means are comprised of photocells.

3. The apparatus of claim 1, wherein said means for interacting with said predetermined portion of said members is comprised of means for applying an adhesive to said portion.

4. The apparatus of claim 1, wherein said means for interacting with said predetermined portion of said members includes a roller moveable into contact with said portion in response to said activating signal.

* * * * *